United States Patent [19]

Lutjens et al.

[11] Patent Number: 4,599,868

[45] Date of Patent: Jul. 15, 1986

[54] VAPORIZATION SYSTEM

[75] Inventors: Robert D. Lutjens, Hacienda Heights; Robert A. Zarate, Ontario, both of Calif.

[73] Assignee: Cryomec, Incorporated, Anaheim, Calif.

[21] Appl. No.: 668,516

[22] Filed: Nov. 5, 1984

[51] Int. Cl.[4] ..... F17C 7/02

[52] U.S. Cl. ..... 62/53; 60/618; 60/648; 237/12.3 B

[58] Field of Search ..... 62/53; 60/618, 648; 126/19.5; 237/12.3 B

[56] References Cited

U.S. PATENT DOCUMENTS

| | | | |
|---|---|---|---|
| 3,068,659 | 12/1962 | Marshall, Jr. | 62/52 |
| 3,229,472 | 1/1966 | Beers | 62/53 |
| 4,031,705 | 6/1977 | Berg | 60/615 |
| 4,036,028 | 7/1977 | Mandrin | 62/52 |
| 4,197,712 | 4/1980 | Zwick | 62/53 |
| 4,290,271 | 9/1981 | Granger | 60/618 |
| 4,420,942 | 12/1983 | Davis et al. | 60/618 |
| 4,438,729 | 3/1984 | Loesch et al. | 62/53 |

*Primary Examiner*—Ronald C. Capossela

*Attorney, Agent, or Firm*—Knobbe, Martens, Olson & Bear

[57] ABSTRACT

A system is disclosed which uses hydraulic oil to directly heat and/or vaporize a fluid, for example a cryogenic fluid. The hydraulic oil flow drives a pump which pumps the fluid through a heat exchanger where it is heated by the same hydraulic oil; therefore, the respective flow rates of the oil and fluid are directly proportional to one another and can be regulated so as to avoid freezing of the oil. The hydraulic oil pump is driven by the shaft power of the heat engine, which in turn gives off hot water and gaseous exhaust that may be utilized to further heat the fluid. The shaft power of the heat engine also drives a pump for pumping oil flowing in an auxiliary hydraulic oil circuit, which pump loads the engine so as to increase the temperature of the water coolant and exhaust.

15 Claims, 2 Drawing Figures

VAPORIZATION SYSTEM

BACKGROUND OF THE INVENTION

This invention relates to a method for pumping and heating and/or vaporizing fluid, and particularly cryogenic fluids. Systems for pumping and heating a fluid to a desired temperature are well known in the art. For example, systems are known for heating liquid nitrogen at −320° F. to provide gaseous nitrogen at a desired pressure and temperature, for example 5,000 psi and 70° F. The vaporized nitrogen has many uses, among which is the displacing of fluids in oil wells.

Before the present invention, the known systems used inefficient Otto-cycle engines, burners, direct fired units, boiler systems, and the like, to directly heat the fluid.

Using the heat rejected from internal combustion engines such as Otto-cycle engines to vaporize small quantities of fluid is very inefficient because the work required to pump the fluid is quite small compared to the power rating of the engine which has relatively poor part-load fuel economy. For this reason, these systems are not practical for pumping and vaporizing significant quantities of fluid. Also, these systems do not use readily available diesel engines to produce the heat.

The use of burners and direct-fired units increases the complexity of the system, leading to reduced reliability and potential hazards where flammable or explosive materials are present. Other systems heat the fluid by using the engine coolant water. A hydraulic oil circuit is utilized to increase the load on the heat engine in order to increase the temperature of the engine coolant water with a back pressure generated to further increase the load. However, the disadvantage of such prior system is that the hydraulic pump is oversized in comparison to the hydraulic motor found in the system. This resulted in a large temperature increase in the hydraulic oil itself necessitating a cooling step utilizing the engine coolant water after it had gone through a heat exchange with the fluid. A further disadvantage of such systems is that this useful heat in the hydraulic oil circuit could not be used in a heat exchanger with the cryogenic fluid for fear of freezing the hydraulic oil.

SUMMARY OF THE INVENTION

The present invention contemplates an improved fluid pumping and heating and/or vaporizing method and system which overcomes the shortcomings of the prior art systems. The present invention uses hydraulic oil from a reservoir to directly heat the fluid in a heat exchanger. Thus, the useful heat generated in the hydraulic oil circuit is not wasted in heat exchange with the engine coolant water, but rather can be used in conjunction with the engine coolant water to efficiently heat and/or vaporize the fluid. Furthermore, and very importantly, the fluid pump is driven by the hydraulic oil flow itself. Because of this, the fluid flow rate through the heat exchanger is directly proportional to the hydraulic oil flow rate therethrough. Therefore, the respective flow rates can be set and regulated to ensure that the hydraulic oil does not freeze in the heat exchanger. Moreover, because of the efficient utilization of both the engine coolant water and the heat in the hydraulic oil circuit to heat and/or vaporize the fluid, excessive pressures and temperatures need not be established in the hydraulic oil circuit. Therefore, the hydraulic oil pump and the fluid pump driven by the hydraulic oil flow can be properly matched to one another thus enhancing the maintainability of the system.

In addition to the hydraulic oil circuit described above, the present invention utilizes the heat rejected by the heat engine in the water cooling system and the exhaust system to further heat the fluid. The present invention utilizes an auxiliary hydraulic oil system, separate from that described above, to load the heat engine. The pressure in this auxiliary system can be varied in order to vary the heat generated by the engine. In this manner, the amount of heat in the water coolant can be controlled. Furthermore, the heat generated by the engine can be regulated independently from the flow rate of the fluid.

Besides utilizing the heat rejected from the heat engine to heat the fluid, the shaft power produced by the heat engine is used to drive the various pumps for the hydraulic and auxiliary oil circuits.

As a consequence of the method and system described above, the oil directly heats the fluid, which is contrary to the teaching of the prior art. Because the oil drives the fluid pump, the flow rate of the fluid is always directly proportional to the flow rate of the oil so that the oil coming out of the hydraulic oil heat exchanger and passing through the pump can be kept at a specific temperature. Thus, all fears that the oil will freeze if used to directly heat the fluid are eliminated.

BRIEF DESCRIPTION OF THE DRAWINGS

A better understanding of this invention as well as further advantages thereof will be had by now referring to the accompanying drawings in which.

DETAILED DESCRIPTION OF THE INVENTION

While the principal embodiment of this invention will be described with respect to vaporization of liquid nitrogen, it should be understood that the basic method and system are applicable to the heating and/or vaporization of other fluids, as well as other cryogenic fluids. It should also be noted that the present invention can be used to heat and/or vaporize fluid and that when the term "heating" is used, it refers to heating and/or vaporizing. The principles of the present invention also apply equally well in reverse, where, for example, it is desired to cool the hydraulic oil by means of another fluid. In this case, the term "heating" as used herein, also takes on the meaning of the word "cooling."

Figure 1:
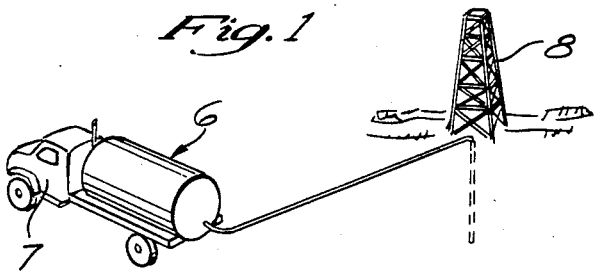
FIG. 1 is a simplified perspective view of the invention, mounted on a diesel truck and being used to displace the oil in an oil well.

Referring first to FIG. 1, a simplified perspective view of the invention 6, mounted on a truck 7, is shown being used to displace the oil in an oil well 8. This is an important use of the present invention. Liquid nitrogen is heated by the present invention until it reaches a gaseous state under high pressure. The nitrogen is then pumped into the oil well to displace crude petroleum trapped in oil bearing strata, thereby enhancing tertiary oil recovery.

Figure 2:
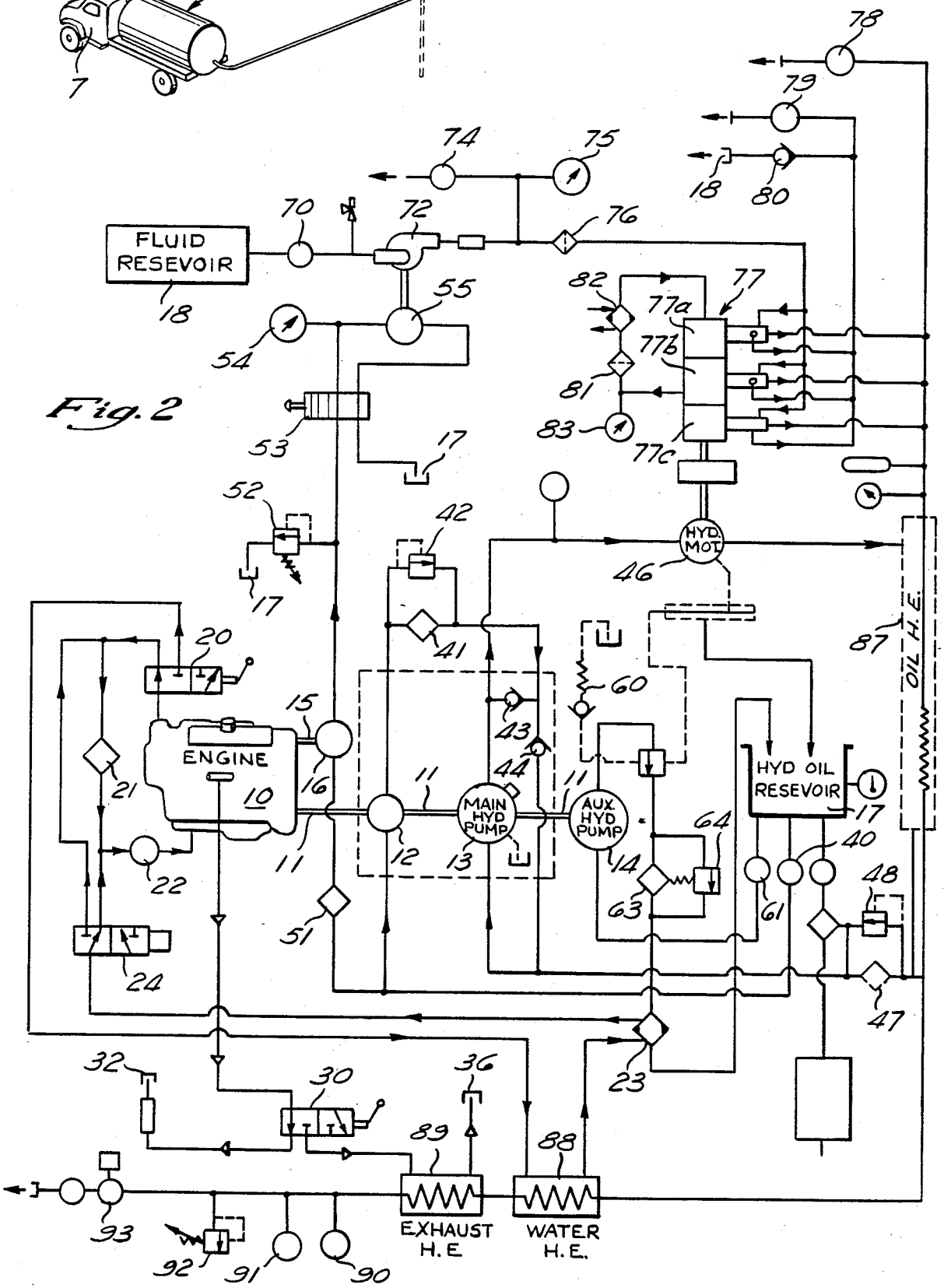
FIG. 2 is a detailed, schematic diagram of a vaporizer system configured in accordance with an actual embodiment of the invention presently in use.

In FIG. 2, the vaporization system is shown to include a diesel engine 10, shafts 11 and 15 turned by the diesel engine 10, pumps 12, 13 and 14 powered by the shaft 11, and pump 16 powered by the shaft 15. Also shown in FIG. 2 are a hydraulic oil reservoir 17 and a liquid nitrogen storage tank 18.

The present vaporization system includes, essentially, the following circuits: a water circuit, designated generally by reference numerals 20–24, which comprises the water coolant system of the engine 10; the engine exhaust system, designated generally by reference numerals 30–36; the main hydraulic oil system referenced by numerals 40–59; the auxiliary oil circuit referenced by numerals 60–69; and the liquid nitrogen circuit denoted by numerals 70–99. The direction of flow in the circuit conduits is indicated by the arrows in FIG. 2.

Water Circuit

The water circuit, generally denoted by the numbers 20–24, is shown in the lower lefthand corner of FIG. 2. The water circuit is shown to include the heat engine 10, a radiator 21, a water pump 22, a hot water heat exchanger 88, a hydraulic oil to water heat exchanger 23, and two thermostats, 20 and 24. The water pump 22 draws the water from the engine 10. If the water is cooler than, a certain level, for example, 170° F., the thermostat 20 returns the water to the engine 10 through the pump 22. If the water leaves the engine 10 at a temperature above the predetermined level, the thermostat 20 meters the water to the hot water heat exchanger 88 where it is cooled by the liquid nitrogen and where it heats the liquid nitrogen. Entering the heat exchanger 88, the water may be in the range of 180°–195°, and leaves around 150° F. The water then passes through an auxiliary oil to water heat exchanger 23 where it is heated by the auxiliary oil to an acceptable temperature, such as 170° F., at the same time serving to cool the hydraulic oil flowing in this auxiliary circuit. The water next flows to the thermostat 24. If the water is hotter than 180° F., the thermostat 24 meters the water to the radiator 21, then through the pump 22 and back into the engine 10, while if the water is at a temperature less than a predetermined temperature, such as 180° F., the thermostat 24 returns the water directly to the engine 10.

Exhaust Gas Circuit

Also shown in the lower lefthand corner of FIG. 2 is an exhaust circuit, denoted by the numbers 30–36, which includes the engine 10, a bypass control 30, a vent 32, an exhaust gas heat exchanger 89, and a second vent 36. In the exhaust circuit, the exhaust leaves the engine 10 at a high temperature. The bypass control 30 then vents the exhaust to the atmosphere through vent 32 if the bypass is set. If the bypass is not set in the bypass control 30, the bypass control 30 passes the exhaust through the exhaust gas heat exchanger 89, where it heats the nitrogen, and then vents the exhaust gas to the atmosphere through vent 36.

Main Hydraulic Oil Circuit

The main hydraulic oil circuit is shown in the center portion of FIG. 2, and is denoted generally by the numbers 40–59. The hydraulic oil circuit includes the hydraulic oil reservoir 17, a hydraulic oil heat exchanger 87, two valves 40 and 53, four pumps 12, 13, 16, and 55, a hydraulic motor 46, three filters 23, 41 and 47, two gauges 45 and 54, and three relief valves 42, 48 and 52.

In the hydraulic oil circuit, the pump 13 pumps the hydraulic oil through the motor 46 to drive the liquid nitrogen high pressure pump 77 and then through the hydraulic oil heat exchanger 87 where the hydraulic oil exchanges heat with the liquid nitrogen. Filter 47 cleans the oil and relief valve 48 acts to by-pass the filter 47 if the pressure differential across the filter becomes too great. The main hydraulic oil circuit also includes a fill circuit, in which the pump 12 draws hydraulic oil from the hydraulic oil reservoir 17, through the valve 40, and then passes the hydraulic oil through the filter 41. The check valves 43 and 44 act to pass hydraulic oil into the hydraulic oil circuit when necessary because of losses in the hydraulic oil circuit due to leakage.

In the present invention, the main hydraulic oil pump 13 and the hydraulic motor 46 are properly matched to one another, as opposed to the prior art in which the pump is oversized in comparison to the motor. Thus, in the present invention no excessive pressures or temperatures are generated in the hydraulic oil system, thereby avoiding damage or maintenance problems.

An ancillary purpose of this main oil circuit is to drive hydraulic motor 55 which powers boost pump 72. In this part of the circuit, the pump 16 draws the hydraulic oil through the valve 40 and the filter 51 from the hydraulic oil reservoir 17. If the valve 53 is open, the pump 16 passes the hydraulic oil through the valve 53, the gauge 54, and the motor 55. The auxiliary oil then returns to the hydraulic oil reservoir 17. If the valve 53 is closed, the hydraulic oil passes through the relief valve 52 and then returns to the hydraulic oil reservoir 17.

Auxiliary Oil Circuit

The lower righthand side of FIG. 2 shows an auxiliary oil circuit, denoted by the numbers 60–69. This circuit includes the hydraulic oil reservoir 17, a valve 61, the pump 14, three relief valves 60, 62 and 64, a filter 63, and an auxiliary oil to water heat exchanger 23. The pump 14 draws the auxiliary hydraulic oil through the valve 60 from the hydraulic oil reservoir 17 and then passes the auxiliary oil through the relief valve 62, the filter 63 and the second relief valve 64. The auxiliary oil then passes through the auxiliary oil to water heat exchanger 23 and returns to the hydraulic oil reservoir 17. In the heat exchanger 23, the auxiliary oil heats the water, which has just been cooled by the liquid nitrogen, to an acceptable temperature, such as 170° F., so that it can safely return to the engine block.

The primary purpose of this auxiliary oil circuit is to increase the load on the engine 10 in order to increase the temperature of the water leaving the engine 10. The pressure in the auxiliary oil circuit can be varied by adjusting the relief valve 60. Thus, the load on the engine 10, and therefore the heat produced by the engine 10, can be varied independently of the main hydraulic oil circuit by varying the pressure in only the auxiliary oil circuit.

Liquid Nitrogen Circuit

Finally, a nitrogen circuit is shown along the upper, right, and lower edges of FIG. 2 and is denoted generally by the numbers 70–99. The nitrogen circuit includes, principally, the liquid nitrogen tank 18, the liquid nitrogen boost pump 72, the liquid nitrogen high pressure pump 77, the hydraulic oil heat exchanger 87, the hot water heat exchanger 88, and the exhaust gas heat exchanger 89. The nitrogen circuit also includes an inlet valve 70, a valve 74 leading to the boost pump priming vent (not shown), a valve 79 leading to a vent to atmosphere (not shown), a valve 78 leading to a high pressure pump priming vent (not shown), an outlet valve 93, a check valve 80 leading to a vent return to the tank 18, a water cooler 82, gauges 75, 83 and 90, filters 76 and 81, and a relief valve 92.

The liquid nitrogen is pumped from the tank 18 to the liquid nitrogen high pressure pump 77 by the liquid nitrogen boost pump 72. The liquid nitrogen high pressure pump 77 then pumps the liquid nitrogen through the hydraulic oil heat exchanger 87 where the liquid nitrogen is heated by the hydraulic oil. Because the liquid nitrogen high pressure pump 77 is powered by the main hydraulic oil flow going through the motor 46 and the hydraulic oil heat exchanger 87, the amount of hydraulic oil passing through the hydraulic heat exchanger 87 is directly proportional to the amount of liquid nitrogen flowing through the hydraulic oil heat exchanger 87. Consequently, the temperature of the hydraulic oil leaving the hydraulic heat exchanger 87 can be directly controlled and the hydraulic oil prevented from freezing, thus permitting the use of the hydraulic oil to directly heat the liquid nitrogen. After leaving the hydraulic oil heat exchanger 87, the nitrogen then passes through the hot water heat exchanger 88 where it is further heated by the water coolant coming from the engine 10. If further heating is required, the nitrogen is heated in the exhaust gas heat exchanger 89 where it is further heated by the exhaust leaving the engine 10. Finally, the nitrogen, now in a gaseous state, is discharged through the outlet valve 93.

Until the liquid nitrogen boost pump 72 is primed, the valve 74 is opened so that the liquid nitrogen being pumped from the tank 18 can be vented to the atmosphere. This prevents the boost pump 72 from having to push against a head until it is fully primed and thereby avoids any damage to the pump 72. Once the gauge 75 registers that the nitrogen circuit is primed, the valve 74 is shut off and the boost pump 72 begins to pump the liquid nitrogen through the filter 76 and toward the high pressure pumps. The liquid nitrogen boost pump 72 is driven by the hydraulic oil flow through the hydraulic motor 55, as described above.

The high pressure pumps 77*a*, 77*b*, and 77*c* are arranged in parallel as shown in FIG. 2 but all pump into the same conduit which flows into the hydraulic oil heat exchanger 87. In order to avoid damage to the high pressure pump 77, valve 78 is opened until they are completely primed, after which valve 78 is closed to produce flow through the liquid nitrogen circuit. Any leakage from the high pressure pumps 77 will be vented to the liquid nitrogen tank 18 through the check valve 80 or vented to the atmosphere through the valve 79. The lubricating oil from pumps 77 is water cooled in which the oil flows through a filter 81 and a water-to-oil heat exchanger 82. A pressure gauge 83 measures the pressure of the lubricating oil.

What is claimed is:

1. A system for transferring heat from a first fluid to a second fluid, said first and second fluids having a high temperature differential, comprising:

means for pumping said first fluid at a first flow rate through a fluid circuit, said first flow rate being variable;

means for pumping said second fluid at a second flow rate through a second fluid circuit, said second flow rate being variable; and a heat exchanger located in both said first and second circuits such that heat in said first fluid is transferred to said second fluid, in order to reduce said high temperature differential to a lower temperature differential; and means for regulating said first and second flow rates such that said first flow rate is directly proportional to said second flow rate and such that variations in said first flow rate produce a proportional variation in said second flow rate whereby said lower temperature differential is maintained thus avoiding excessive temperatures in said first fluid or said second fluid.

2. The system of claim 1 wherein the work produced by said first fluid pumping means is directly proportional to the flow rate of said second fluid.

3. The system of claim 1 wherein said first fluid pumping means is powered by the flow of said second fluid.

4. The system of claim 1 further comprising:

a heat engine for providing power to said second fluid pumping means; and a second heat exchanger for transferring heat from said heat engine to said first fluid to further heat said first fluid.

5. The system of claim 4 further comprising a means for loading said heat engine to increase the heat available to said second heat exchanger.

6. The system of claim 6 wherein said loading means is not proportional to the flow of said first fluid.

7. The system of claim 5 wherein said loading means comprises a third fluid flowing in a third fluid circuit.

8. The system of claim 7 wherein the flow of said third fluid is produced by said heat engine.

9. The system of claim 7 further comprising means for increasing the pressure in said third fluid circuit to increase the load on said heat engine, thereby increasing the heat available to said second heat exchanger.

10. A system for heating and/or vaporizing a cryogenic fluid, comprising:

a cryogenic fluid circuit through which said cryogenic fluid flows;

a heat exchanger through which said cryogenic fluid flows;

a first fluid flowing in a first fluid circuit providing means for powering said cryogenic fluid through said heat exchanger, changes in the flow rate of said first fluid producing proportional changes in the flow rate of said cryogenic fluid;

means for powering the first fluid through said first fluid circuit, said powering means producing heat in said first fluid which is exchanged with said cryogenic fluid in said heat exchanger;

means for increasing the amount of heat produced by said power means; and means for regulating said heat increasing means independent of the flow rate of the fluid in said first fluid circuit.

11. The system of claim 10 further comprising a heat exchanger in which the heat in said first fluid circuit is transferred to said cryogenic fluid to further heat and/or vaporize said cryogenic fluid.

12. A method for heating and/or vaporizing a fluid comprising the steps of:

(a) passing a first fluid to be heated and/or vaporized through a heat exchanger;

(b) passing a second fluid through a motor which causes said first fluid to pass through said heat exchanger;

(c) passing said second fluid through said heat exchanger whereby said second fluid is used to directly heat said first fluid; and (d) maintaining the flow rates of said first and second fluids proportional in order to prevent excessive heat transfer.

13. The method of claim 12 further comprising the steps of:

(a) passing said first and second fluids through said heat exchanger such that their flow rates are proportional; and (b) regulating the proportional flow rates of said first and second fluids so as to control the amount of heat transfer in said heat exchanger.

14. The method of claim 12 further comprising the steps of:

(a) pumping said first and second fluids by means of a heat engine;

(b) heating said first fluid by means of the heat generated by said heat engine;

(c) pumping a third fluid by means of said heat engine in order to increase the heat generated by said heat engine; and (d) regulating the pressure of said third fluid in order to regulate the heat generated by said heat engine.

15. A system for transferring heat from a hydraulic fluid to a cryogenic fluid, comprising:

a heat exchanger for transferring heat directly from said hydraulic fluid to said cryogenic fluid;

a pump for pumping said hydraulic fluid through said heat exchanger;

a pump for pumping said cryogenic fluid through said heat exchanger; and a hydraulic motor powered by said hydraulic fluid for powering said cryogenic fluid pump.

* * * * *